US006286265B1

(12) United States Patent
Rinderer

(10) Patent No.: US 6,286,265 B1
(45) Date of Patent: Sep. 11, 2001

(54) RECESSED LIGHTING FIXTURE MOUNTING

(75) Inventor: Eric R. Rinderer, Highland, IL (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 09/496,113

(22) Filed: Feb. 1, 2000

(51) Int. Cl.[7] ..... E04C 3/30

(52) U.S. Cl. ..... 52/28; 52/733.3; 52/506.07; 52/664; 52/668

(58) Field of Search ..... 52/28, 733.3, 733.2, 52/733.1, 220.6, 506.07, 506.06, 664, 669, 668, 39; 248/343

(56) References Cited

U.S. PATENT DOCUMENTS

| | | | |
|---|---|---|---|
| 3,343,309 | | 9/1967 | Netz et al. . |
| 3,597,889 | | 8/1971 | Nigro . |
| 4,041,657 | | 8/1977 | Schuplin . |
| 4,086,480 | | 4/1978 | Lahm . |
| 4,114,327 | | 9/1978 | Williams . |
| 4,122,762 | | 10/1978 | Williams . |
| 4,230,900 | | 10/1980 | Speet . |
| 4,356,537 | | 10/1982 | Stahlhut et al. . |
| 4,408,262 | | 10/1983 | Kusmer . |
| 4,419,717 | | 12/1983 | Price et al. . |
| 4,608,801 | * | 9/1986 | Green et al. ..... 52/664 |
| 4,646,212 | | 2/1987 | Florence . |
| 4,716,504 | | 12/1987 | Pahl et al. . |
| 5,045,985 | | 9/1991 | Russo et al. . |
| 5,072,344 | | 12/1991 | Fabbri . |
| 5,085,393 | | 2/1992 | Ryan . |
| 5,386,959 | | 2/1995 | Laughlin et al. . |
| 5,588,737 | | 12/1996 | Kusmer . |
| 5,941,029 | | 8/1999 | MacLeod . |
| 6,047,517 | | 4/2000 | Vrame . |

OTHER PUBLICATIONS

SP Products, Inc. publication (2 pages) entitled "EZ Bar Hanger System" describing hanger system admitted to be prior art.

* cited by examiner

*Primary Examiner*—Christopher T. Kent
*Assistant Examiner*—Jennifer I. Thissell
(74) *Attorney, Agent, or Firm*—Senniger, Powers, Leavitt & Roedel

(57) ABSTRACT

A support for mounting a lighting fixture in recessed position in a suspension ceiling of inverted T-bars extending generally parallel to one another and spaced apart a certain distance. The support is in the form of an elongate sheet metal bar for installation in generally vertical position bridging two T-bars. As installed, the sheet metal bar has upper and lower edges and a pair of notches in its lower edge spaced apart the aforesaid distance. The sheet metal bar is placeable in a bridging position on the two inverted T-bars with the two T-bars extending through the notches in the support bar. The sheet metal bar has end portions extending outward beyond the notches. Each end portion includes a primary tab bendable to extend generally at right angles with respect to the sheet metal bar in position extending alongside an outside face of the respective inverted T-bar. The primary tab is formed to define a secondary tab for being bent to extend generally at right angles to the remainder of the primary tab over the enlarged edge of the respective inverted T-bar.

12 Claims, 18 Drawing Sheets

RECESSED LIGHTING FIXTURE MOUNTING

BACKGROUND OF THE INVENTION

This invention relates to recessed lighting fixture mounting, more particularly to means for and a method of mounting a lighting fixture in a suspended ceiling with the fixture recessed in the ceiling.

The invention is especially concerned with a support bar per se to be used in the installation of a lighting fixture in a suspended ceiling comprising a suspension of inverted T-bars, also the lighting fixture installation comprising the support bars of the invention after a certain bending procedure has been carried out, and further the method of installing the fixture utilizing the support bars.

Reference may be made to the following U.S. patents for examples of recessed lighting fixture mountings heretofore patented:

| U.S. Pat. No. | Title | Issue Date |
|---|---|---|
| 4,086,480 | Suspension Ceiling and Recessed Lighting System | 04/25/78 |
| 4,114,327 | Light Fixture Support | 09/19/78 |
| 4,356,537 | Lighting Fixture Retainer Hook | 10/26/82 |
| 5,045,985 | Self Locking Adjustable Mounting Bars | 09/03/91 |
| 5,072,344 | Lighting Fixture Clamp | 12/10/91 |
| 5,588,737 | Modular Recessed Lighting System | 12/31/96 |

BRIEF SUMMARY OF THE INVENTION

Among the several objects of the invention may be noted the provision of improved means for and a method of mounting a light fixture in a suspended ceiling with the fixture recessed in the ceiling, including a support bar to be used in the installation of a lighting fixture in a suspended ceiling comprising a suspension of inverted T-bars; the provision of a support bar for such use adapted to be bent on the job without the need for any special tools for secure attachment thereof to two inverted T-bars of a ceiling suspension bridging the two inverted T-bars; the provision of such a support bar which, as bent for the attachment thereof to the inverted T-bars, in no way obstructs the lifting up of ceiling tile for placement in the ceiling; the provision of such a support bar which, as installed on two inverted T-bars, is secured against lift-off from the T-bars if an upward force is applied to the bar or to the fixture supported by the bar; and the provision of such a support which is economical to manufacture and use, lending itself to simple and economical installation procedure reflected in the method of mounting the lighting fixture in accordance with the method of the invention.

In a first aspect, and in general, the invention involves a support for mounting a lighting fixture in recessed position in a ceiling. The ceiling comprises a suspension of inverted T-bars, the support being for mounting the fixture between two of the inverted T-bars extending generally parallel to one another and spaced apart a certain distance. Each T-bar has a web constituting the stem of the T and a flange constituting the head of the T, the web having an enlarged edge. Each T-bar has first and second side faces, the first faces being those that face one another and the second being those on the opposite side. The support comprises an elongate sheet metal bar for installation in generally vertical position bridging the two T-bars, the sheet metal bar having an edge constituting its upper edge and an edge constituting its lower edge as it is installed in said vertical position. The sheet metal bar has a pair of notches in its lower edge spaced apart said distance and being placeable in position on the two inverted T-bars bridging the T-bars with the two inverted T-bars extending through the notches. The sheet metal bar has end portions extending outward beyond the notches, each end portion comprising a primary tab bendable to extend generally at right angles with respect to the sheet metal bar in position extending alongside said second face of the respective inverted T-bar. Each end portion comprising the primary tab is formed to define a secondary tab for being bent to extend generally at right angles to the remainder of the primary tab over the enlarged edge of the respective inverted T-bar.

In a second aspect, and in general, the invention involves an installation of a lighting fixture in recessed position in a ceiling, the ceiling comprising a suspension of inverted T-bars including two inverted T-bars extending generally parallel to one another spaced apart a certain distance. Each T-bar has a web constituting the stem of the T and a flange constituting the head of the T, the web having an enlarged edge. Each T-bar has first and second side faces, the first faces being those that face one another and the second being those on the opposite side. The installation comprises a pair of supports bridging the two T-bars with a space between the supports, and a lighting fixture supported by the supports in position between the supports and between the two T-bars extending up with respect to the level of the T-bars. Each support comprises an elongate sheet metal bar installed in generally vertical position bridging the two T-bars and thereby having an upper edge and a lower edge. Each sheet metal bar has a pair of notches in its lower edge spaced apart said distance receiving the two inverted T-bars. Each sheet metal bar has the upper edge of each notch bearing on the respective inverted T-bar. Each sheet metal bar has end portions outward of the notches, each end portion comprising a primary tab bent to extend generally at right angles with respect to the sheet metal bar alongside said second face of the respective inverted T-bar. Each end portion comprising the primary tab has a secondary tab bent to extend generally at right angles therefrom over the enlarged edge of the respective inverted T-bar.

In a third aspect, and again in general, the invention involves a method of installing a lighting fixture in recessed position in a ceiling. The ceiling comprises a suspension of inverted T-bars including two inverted T-bars extending generally parallel to one another and spaced apart a certain distance, each T-bar having a web constituting the stem of the T and a flange constituting the head of the T, the web having an enlarged edge. Each T-bar has first and second side faces, the first faces being those that face one another and the second being those on the opposite side. The method comprises placing a pair of supports in position bridging the two T-bars with a space between the supports for supporting the fixture. Each support comprises an elongate sheet metal bar placed in generally vertical position on the two T-bars and thereby having an upper edge and a lower edge. Each sheet metal bar has a pair of notches in its lower edge spaced apart said distance and emplaced with the enlarged edges of the webs of the two inverted T-bars received in the notches and the upper edges of the notches bearing on the enlarged edges of the two inverted T-bars. Each sheet metal bar as applied has end portions extending straight out beyond the notches. The method involves bending the end portions to form primary tabs extending generally at right angles with respect to the sheet metal bars alongside the second faces of the two inverted T-bars, and bending portions of the primary tab comprising secondary tabs to extend generally at right angles therefrom over the enlarged edges of the two inverted T-bars.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 15:
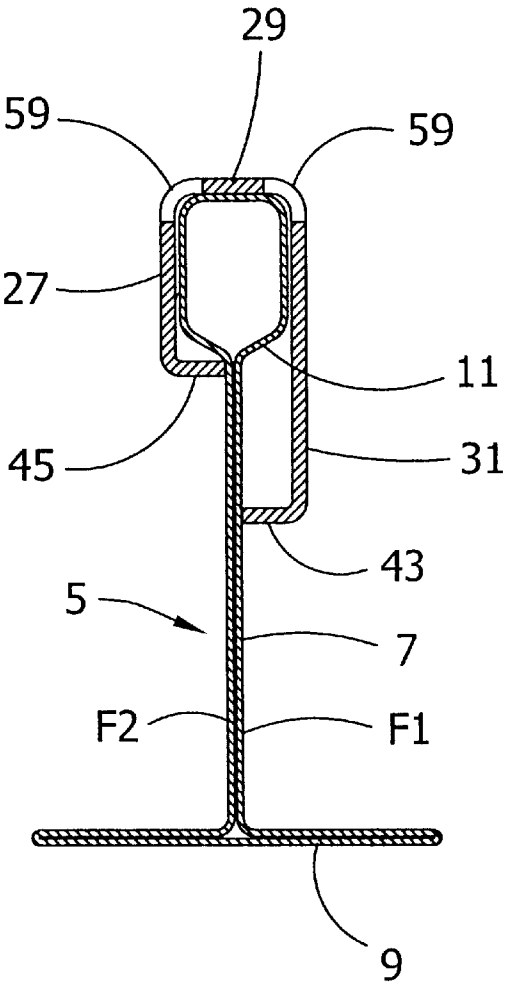
FIG. 15 is an enlarged cross-section on line 15—15 of FIG. 14.
Figure 14:
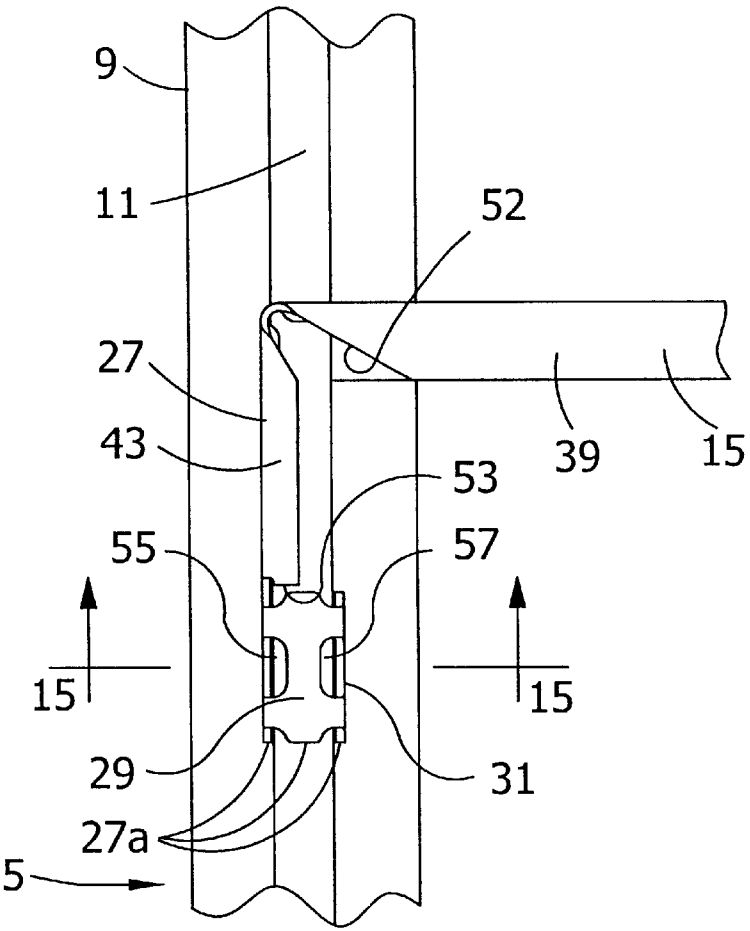
FIG. 14 is a fragment of FIG. 1 in plan, on a larger scale than FIG. 1.
Figure 16:
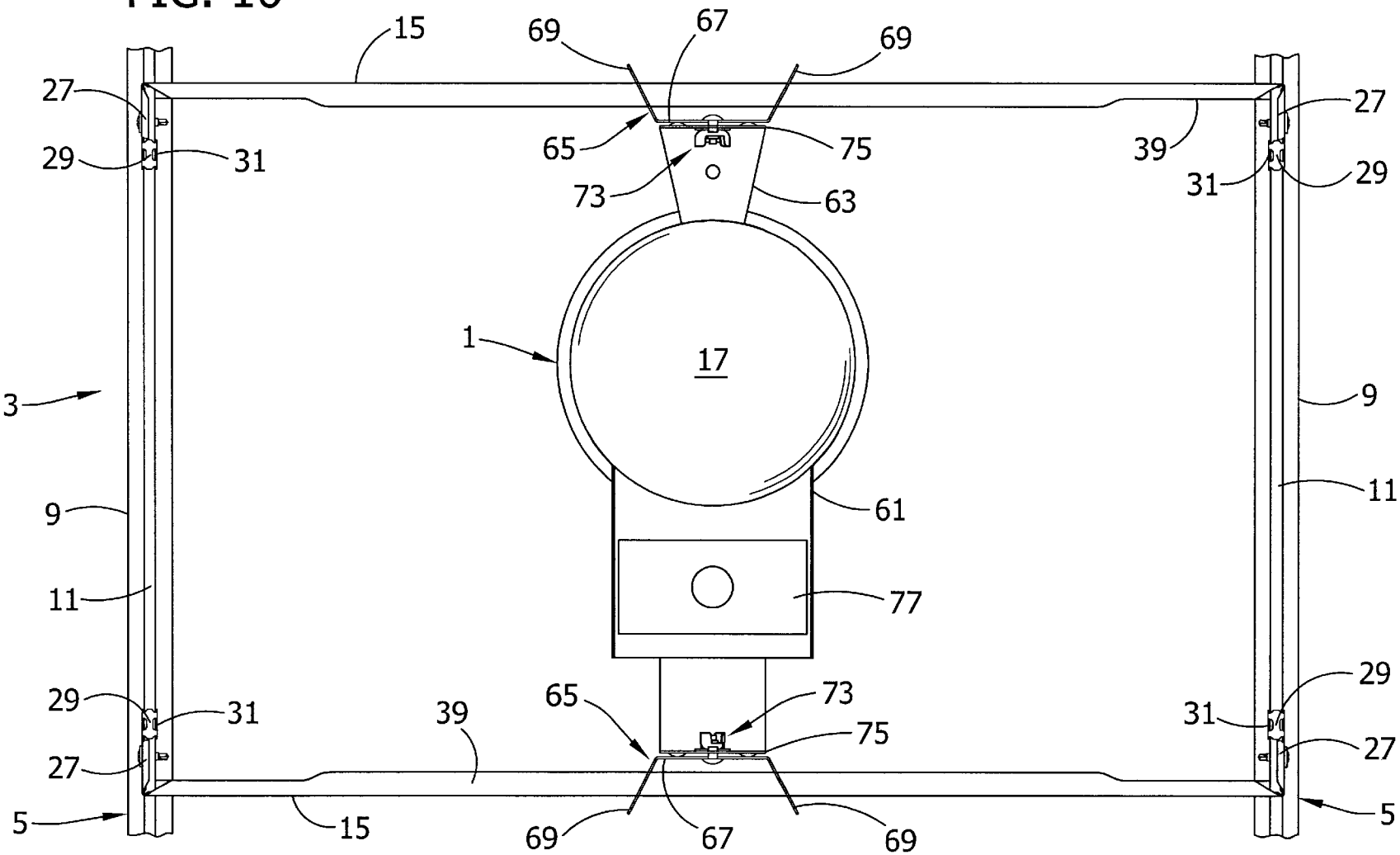
FIG. 16 is a plan of FIG. 1.
Figure 18:
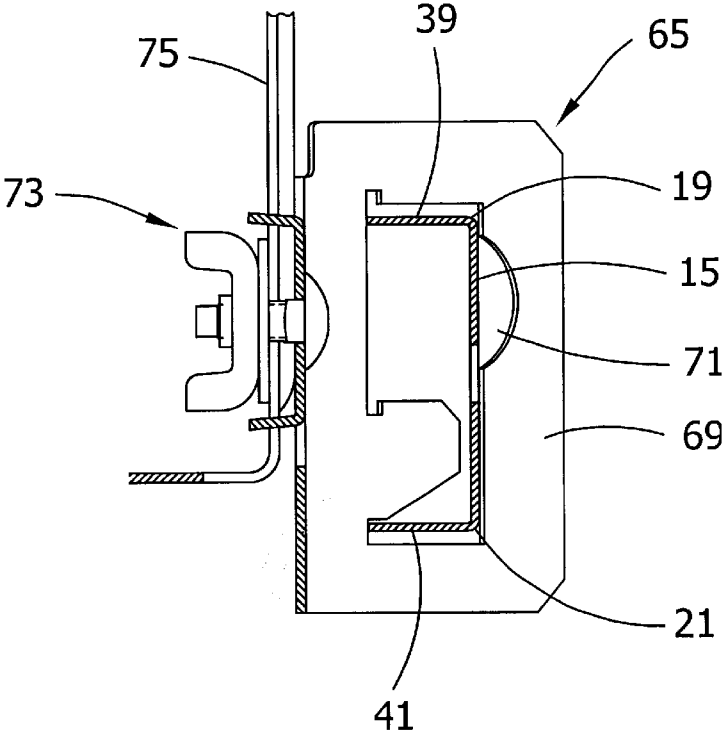
FIG. 18 is a cross-section on line 18—18 of FIG. 17.
Figure 17:
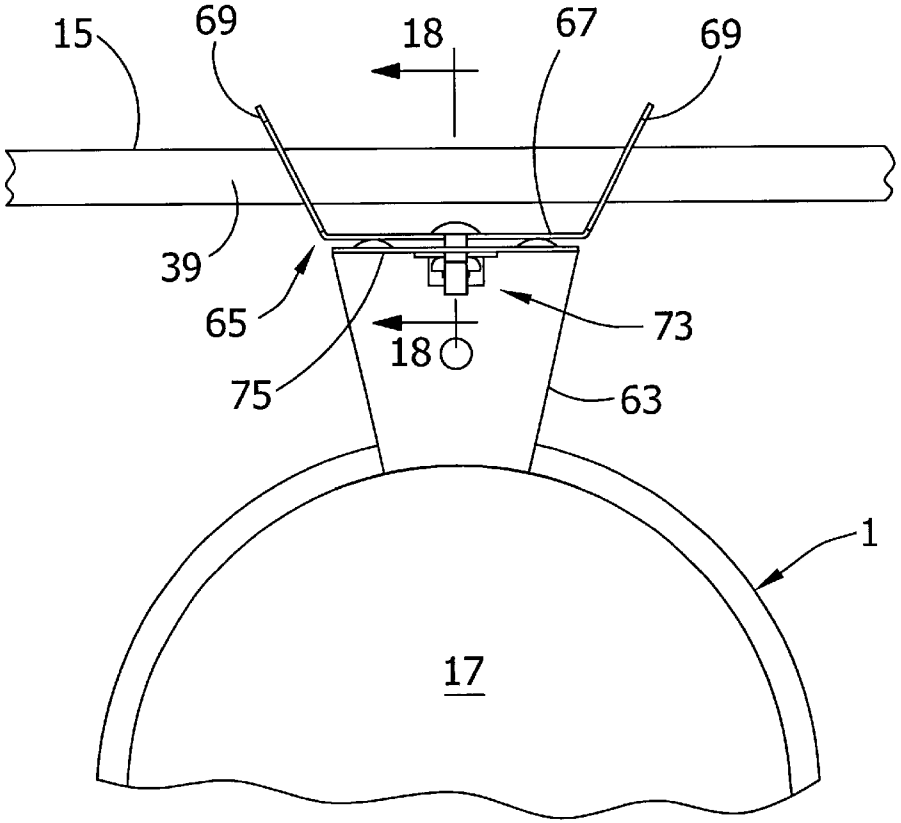
FIG. 17 is an enlarged fragment of FIG. 16.
Figure 19:
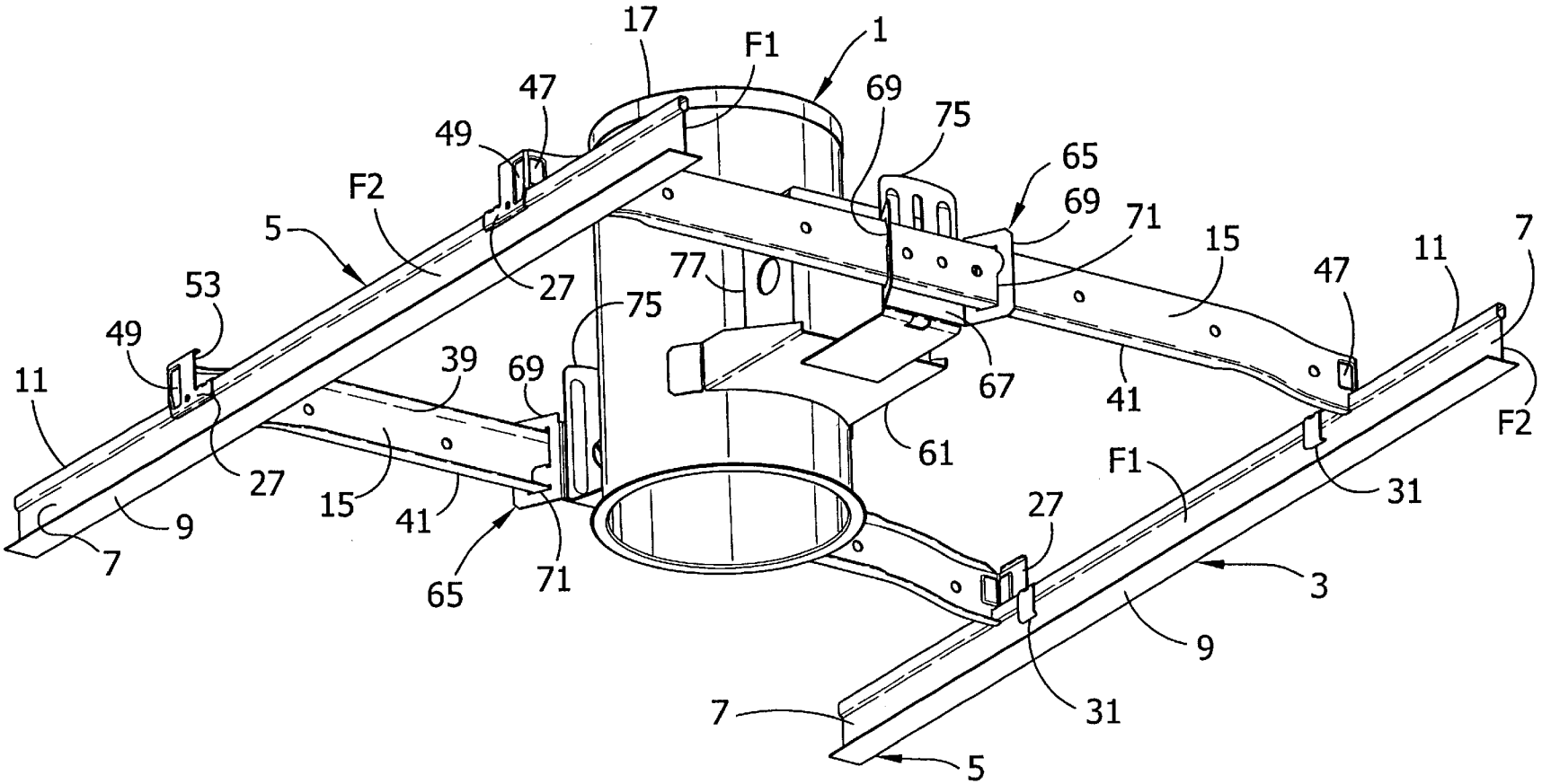
FIG. 19 is a view in perspective of a completed installation from a different angle than FIG. 1.

Referring to the drawings, first more particularly to FIGS. 1, 12, 13, 16 and 19, there is indicated at 1 a lighting fixture installed in accordance with this invention in recessed position in a ceiling generally indicated by the reference numeral 3. The ceiling conventionally comprises a suspension of inverted T-bars including two inverted T-bars, each designated in its entirety by the reference numeral 5, extending parallel to one another and spaced apart a certain selected distance indicated at D in FIG. 1. Each T-bar is made of sheet metal with a conventional cross-section, having a web 7 constituting the stem of the T and a flange 9 constituting the head of the T, the web having an enlarged edge 11 (a "bulb" as it is known). Reference is made particularly to FIG. 15 for detail of the cross-section. It will be understood that the bars are part of a ceiling held suspended from an overhead structure by means such as indicated in phantom at 13 in FIG. 1. Each T-bar has first and second side faces F1 and F2, respectively, the first faces F1 being those that face one another and the second faces F2 being those on the opposite side.

The installation comprises a pair of supports, each designated in its entirety by the reference numeral 15, bridging the two T-bars 5 with a space between the two supports. As depicted, the lighting fixture 1 comprises a hollow cylindrical body housing a socket for a light bulb, the body having a top wall 17 and an open bottom. The fixture is supported by the two supports 15 in a position between the supports and between the two T-bars 5, the fixture extending up with respect to the level of the T-bars.

Each support 15 comprises an elongate sheet metal bar installed in a generally vertical position bridging the two T-bars 5 and thereby having an upper edge 19 and a lower edge 21. Each support or bar 15 has a pair of notches 23 in its lower edge 21 spaced apart distance D for receiving the two inverted T-bars 5 so that the upper edge 25 of each notch bears on the respective inverted T-bar (on the bulb 11 thereof). Each bar 15 has end portions 27 (one at one end of the bar, the other at the other end of the bar) each comprising a primary tab bent to extend generally at right angles with respect to the bar alongside the second face F2 of the respective inverted T-bar. Each so bent end portion or primary tab 27 has a secondary tab 29 bent to extend in a generally horizontal plane generally at right angles therefrom across the enlarged edge 11 (the bulb) of the respective inverted T-bar. Each secondary tab 29 has a tertiary tab 31 bent down from the secondary tab on the first face F1 of the respective inverted T-bar 5.

Figure 1:
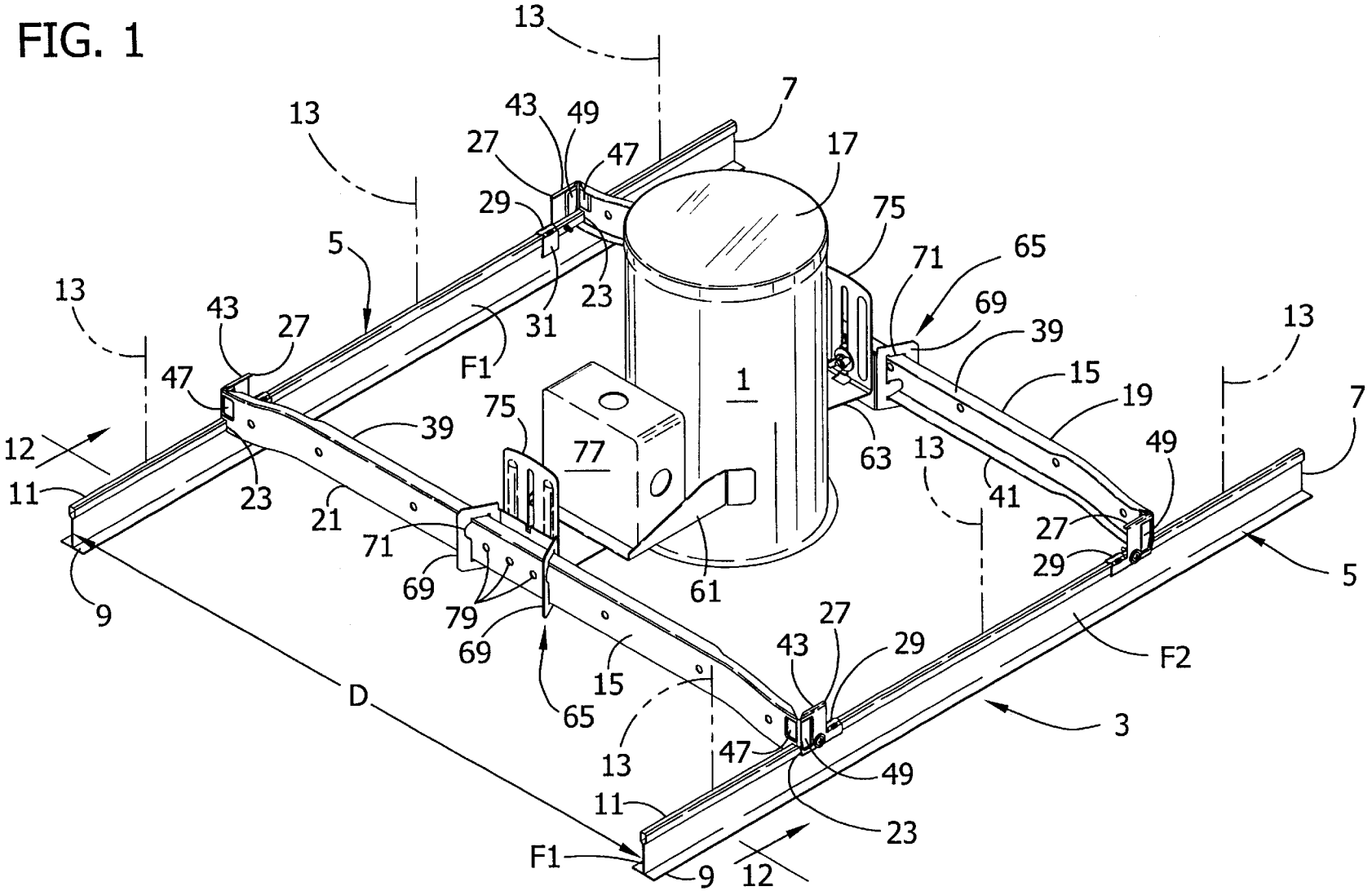
FIG. 1 is a view in perspective of a completed installation of a lighting fixture in accordance with this invention.
Figure 2:
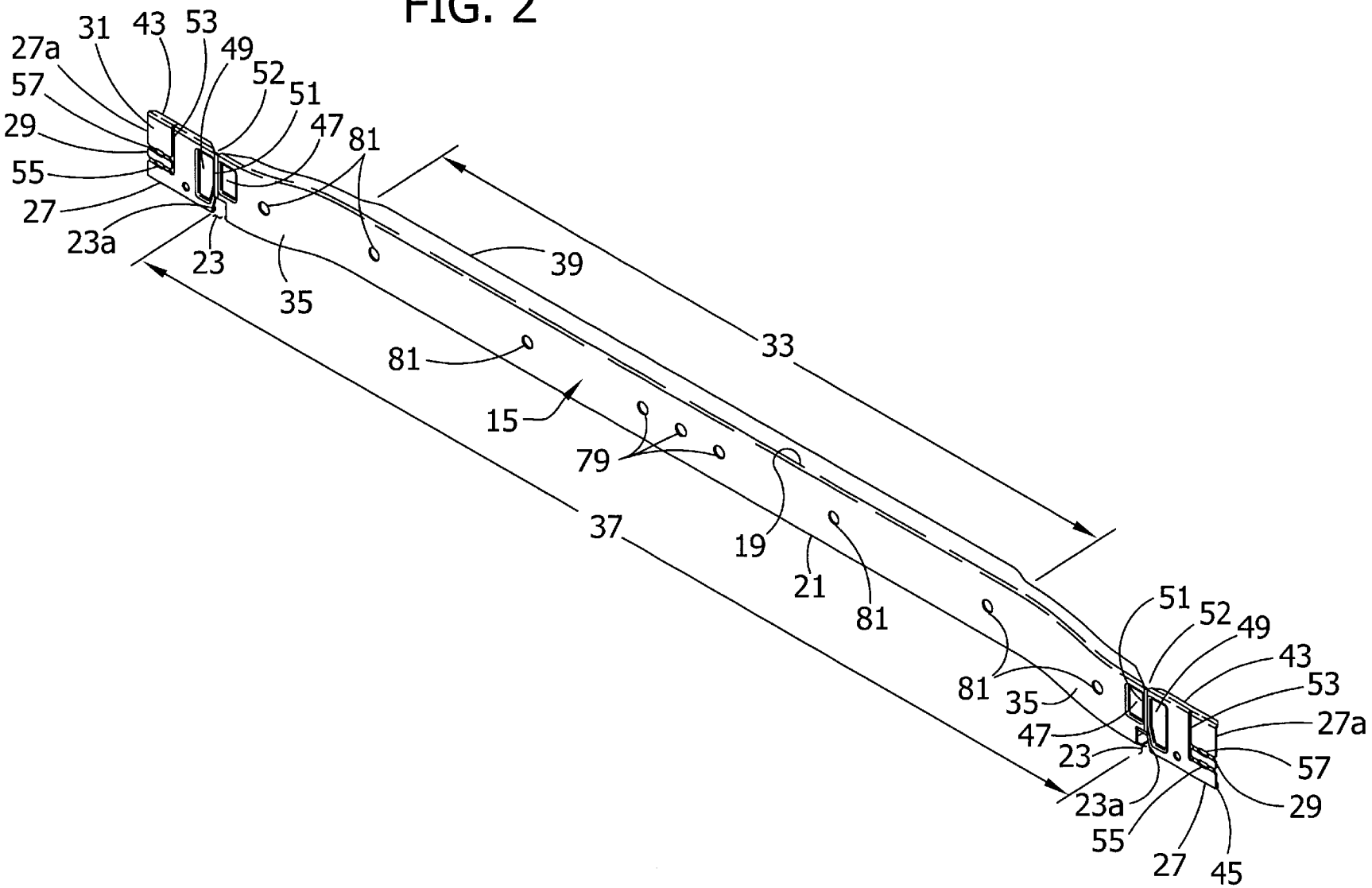
FIG. 2 is a view in perspective of a support per se of this invention constituting one of the two supports shown in FIG. 1 prior to installation.

A support 15 of this invention is shown per se in FIG. 2 in its initial condition as supplied for a light fixture installation procedure in accordance with this invention before being bent on the job, as will appear, to have the primary, secondary and tertiary tabs 27, 29 and 31. As shown, each support comprises the elongate sheet metal bar 15 having the aforesaid upper edge 19 and lower edge 21, and the notches 23. As supplied for installation of the lighting fixture 1, the bar is straight as viewed in plan from one end to the other. As viewed in elevation, it has a raised straight intermediate portion indicated at 33 in FIG. 2 extending a major part (e.g., generally six-tenths) of its full length and flanked by somewhat lower portions 35. The lower portions 35 are offset downward from the intermediate portion 33 and include the end portions or primary tabs 27.

That part of the bar 15 from the outer side 23*a* of one notch 23 to the outer side 23*a* of the other notch may be referred to as the T-bar bridging part of the bar and is indicated at 37. This bridging part of the bar has a relatively wide flange along its upper edge 19 as indicated at 39 and a similar flange along its lower edge 21 as indicated at 41 thereby being generally of channel shape in vertical (transverse) section to stiffen the bar. Each of the notches 23 is in the lower edge of portions 35 of the bar 15 at the ends of the bridging part 37 of the bar. The lower flange 21 extends into each notch 23 a short distance, as indicated at 21*a* so that, when the bar 15 is installed, flange portions 21*a* underlie the enlarged edges of the T-bars to prevent unwanted lift-off of the bar 15 from the T-bars in the event an upward force is applied to the bar or to the fixture 1 after installation. Each of the end portions 27 of each bar 15 constituting the primary tabs is of generally rectangular shape has a relatively narrow flange 43 along its upper edge and a relatively narrow flange 45 along its lower edge for stiffening the end portions and assisting in precise bending of the end portion, as will appear.

Each lower portion 35 of the bar 15 is formed with a rectangular boss 47 stamped in the metal above the respective notch 23, this boss being offset slightly inward of the outer edge 23*a* of the notch. Each end portion or primary tab 27 is formed with a larger boss 49 of generally rectangular shape with an edge 49*a* having a slightly angled part 49*b* to clear the respective notch (see FIG. 3). Edge 49*a* extends parallel to the adjacent edge of boss 47, the formation leaving a narrow strip 51 of sheet metal between the bosses extending vertically (transversely) with respect to bar 15 and generally aligned with the outer side 23*a* of the notch 23 to define a vertical line of bending (a first line of bending) for the ultimate bending of the primary tab to extend in a generally vertical plane generally at right angles to the bridging part 37 of bar 15. Partially V-shaped gaps 52 in the flanging between the outer ends of flange 39 and the inner ends of flanges 43 and the notching away of the flanging at notches 23 permit the bending on the line defined by the strip 51. The bar will bend precisely along this line due to the positioning of the bosses 47, 49 and the stiffening flanges 43, 45 on the primary tab.

The primary tab 27 has a cut 53 extending generally vertically down from its upper edge terminating well short of its lower edge, and has first set of slot and notch openings defining a first bend line 55 extending generally horizontally from the lower end of the cut to the outer edge 27*a* of the primary tab. A second set of slot and notch openings is also formed in the primary tab to define a second bend line 57 extending generally horizontally parallel to and above the first bend line 55 from the cut to the outer end of the primary tab. The portion of the primary tab above the bend line 55 constitutes the aforesaid secondary tab 29 and the portion above the bend line 57 constitutes the aforesaid tertiary tab 31. The two bend lines 55, 57 may be formed in other ways, as by crimping.

The lighting fixture 1 has brackets 61 and 63 on diametrically opposite sides thereof for being mounted on the pair of supports 15 (bars 15) in the space between the suspended ceiling and the overhead structure. Each bracket has a bar receiver 65 generally of C-shape in plan having a vertical web 67 and flanges 69 on the web. The flanges 69 are outwardly flared, each having an opening 71 for receiving the respective bar 15. Each receiver 65 is vertically adjustable as indicated at 73 on an upstanding plate 75 of the respective bracket. Bracket 61 is shown as having a junction box 77 for the fixture mounted thereon.

Figure 3:
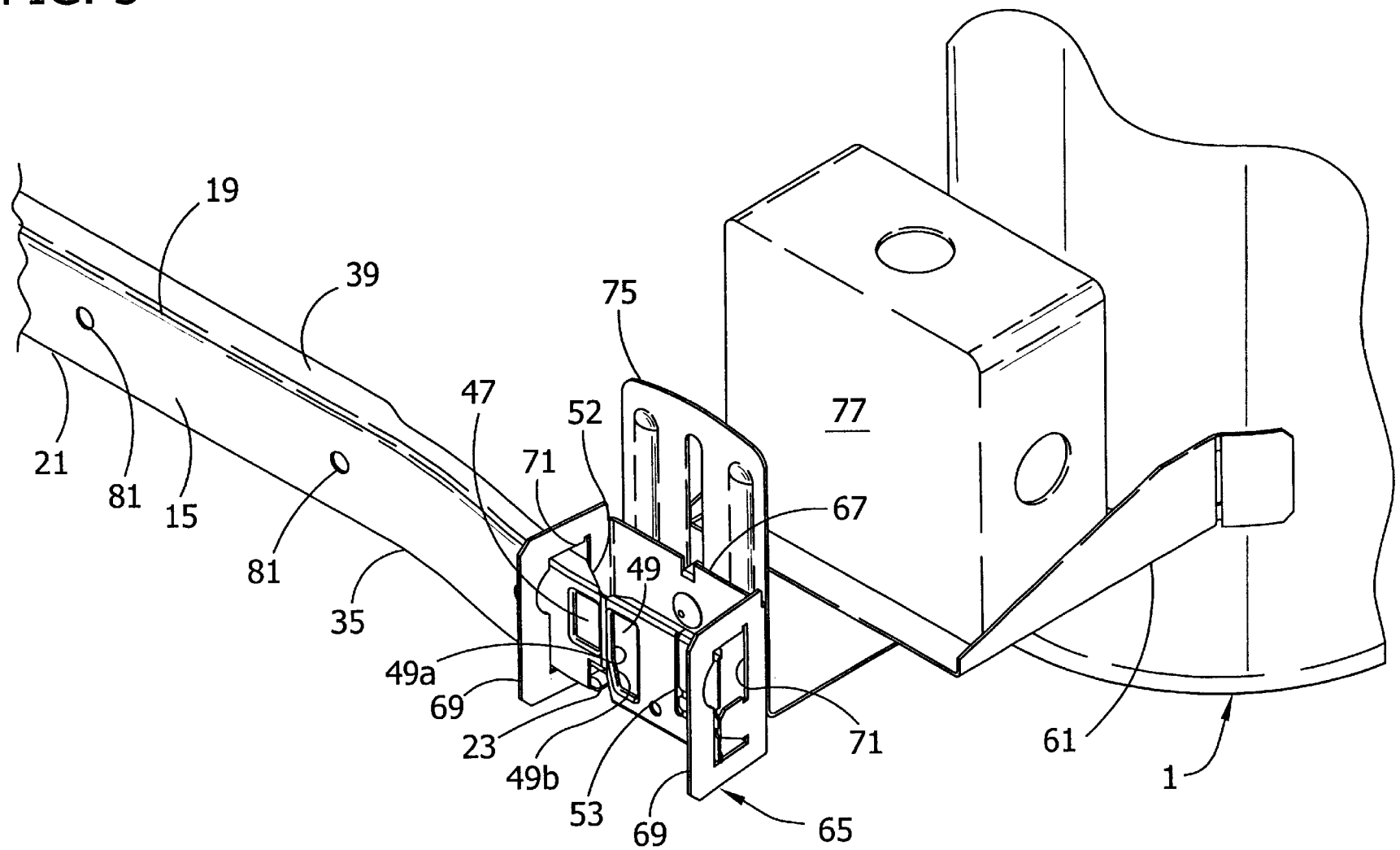
FIG. 3 is a fragmentary view illustrating a step in assembling the support and the fixture for the installation.
Figure 4:
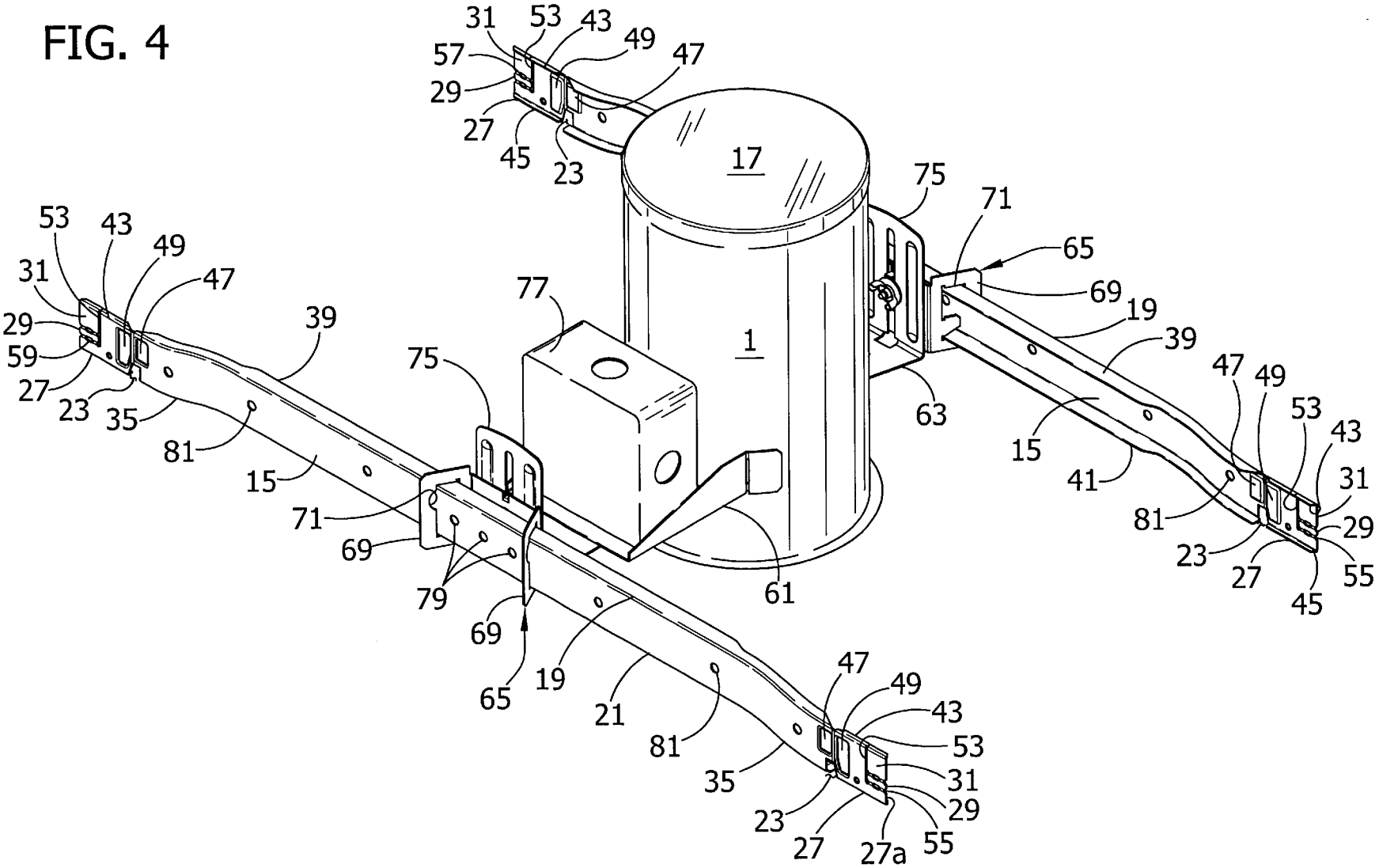
FIG. 4 is a view in perspective of the assembly of the two supports with the fixture for the installation.
Figure 5:
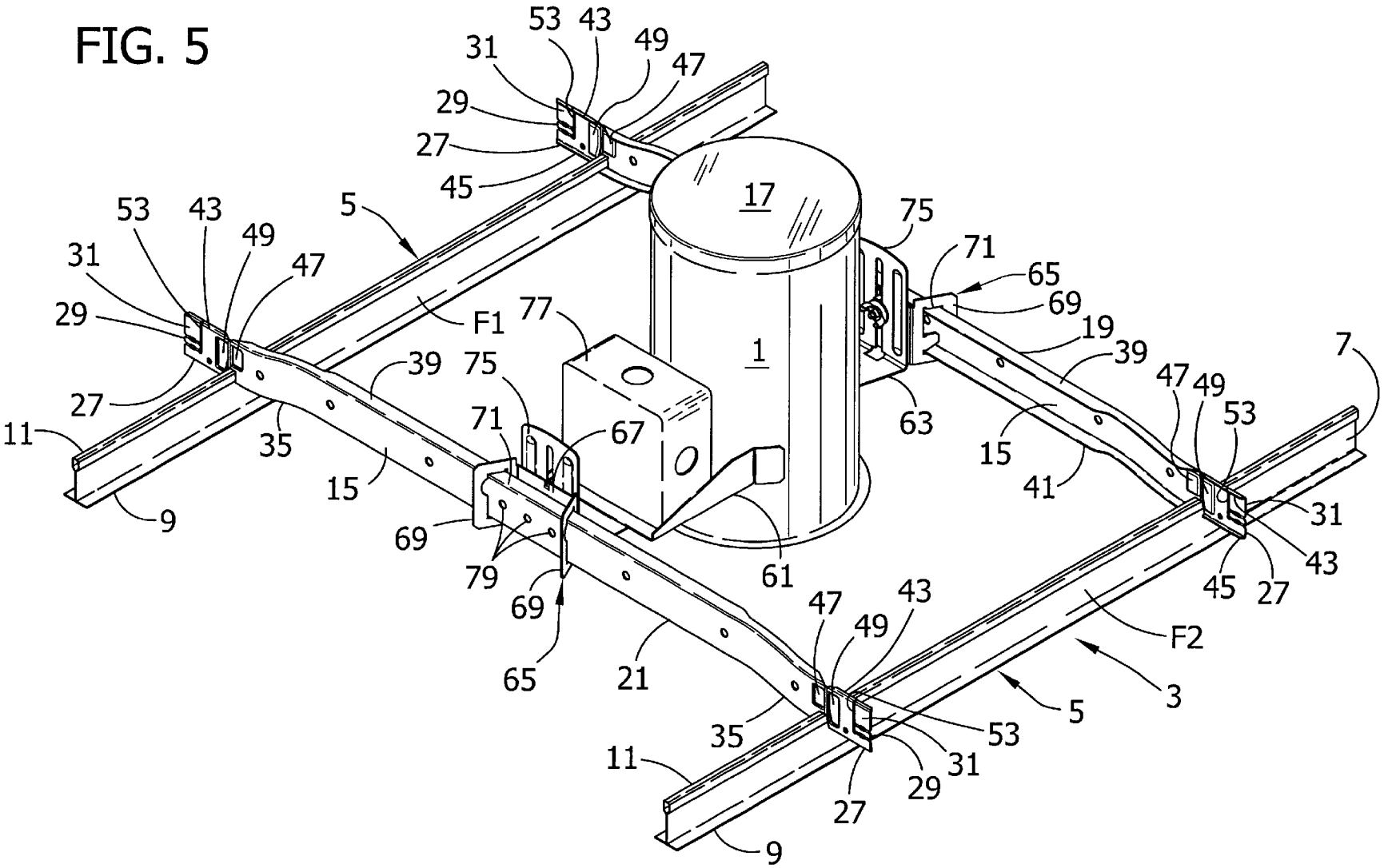
FIG. 5 is a view in perspective showing the placement of the FIG. 4 assembly on two inverted T-bars of a ceiling.
Figure 6:
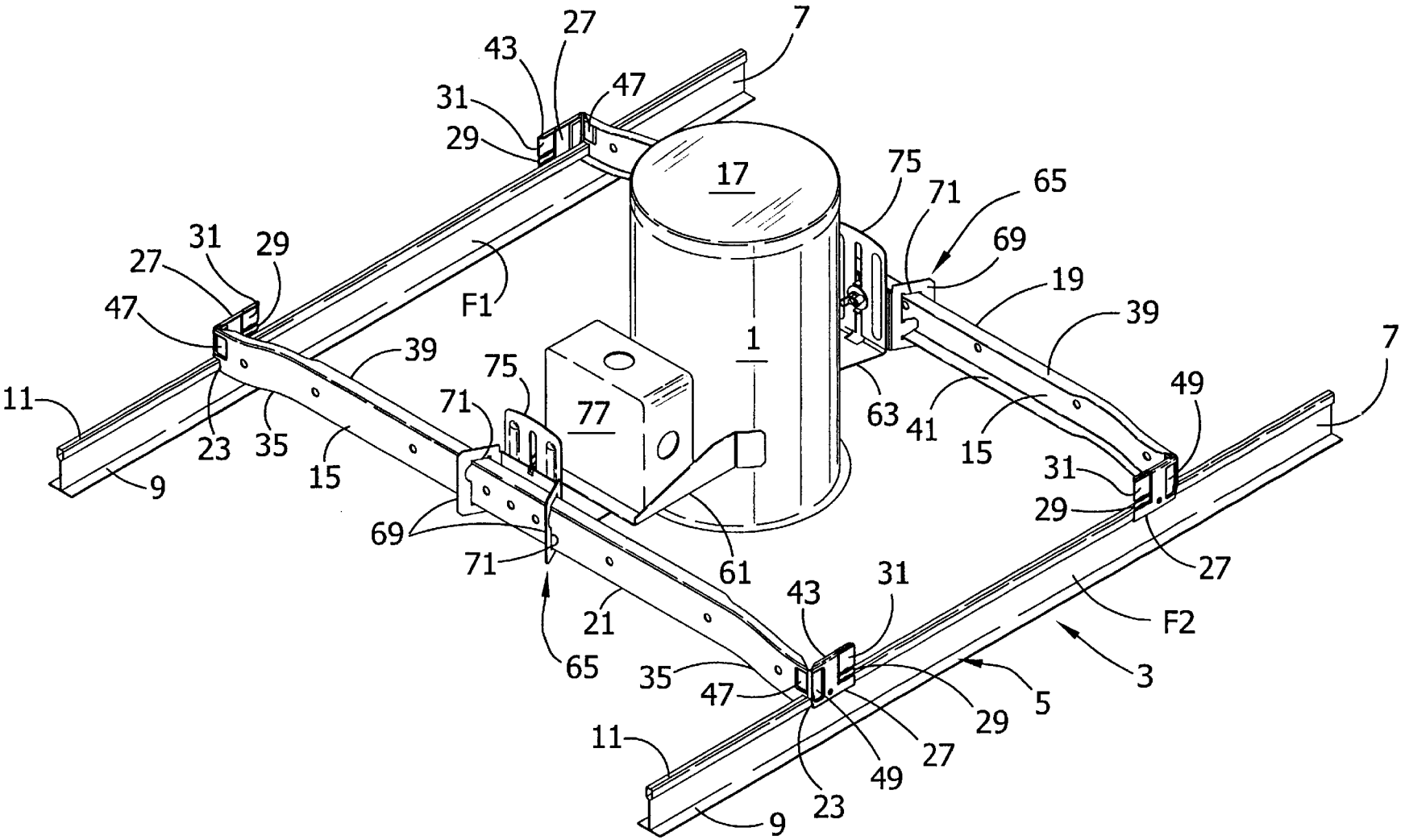
FIG. 6 is a view similar to FIG. 5 illustrating a first step in bending the supports.
Figure 7:
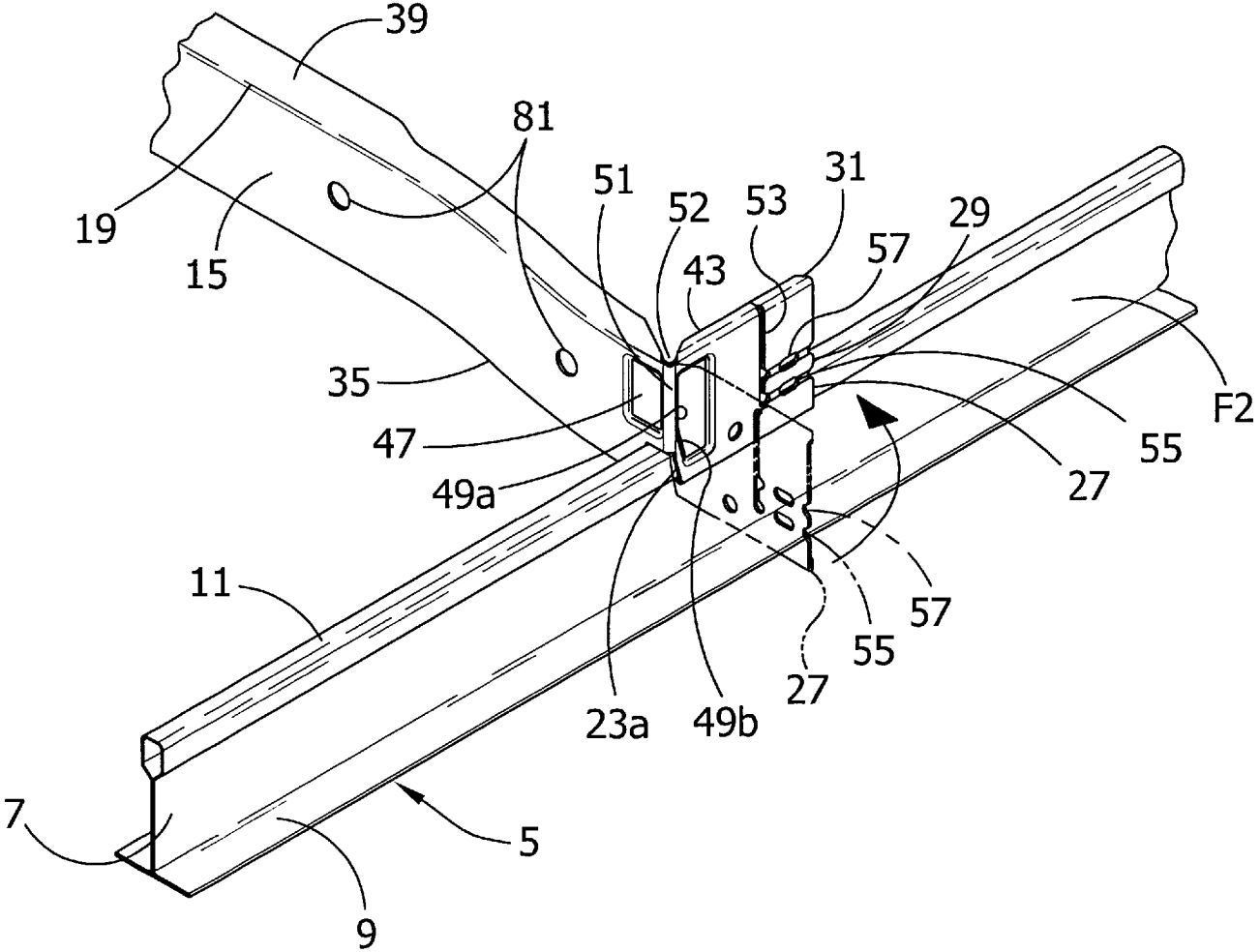
FIG. 7 is an enlarged fragment of FIG. 6 showing in phantom one end of a support before a first bend is made, and showing in solid lines the disposition of said end after the first bend.
Figure 8:
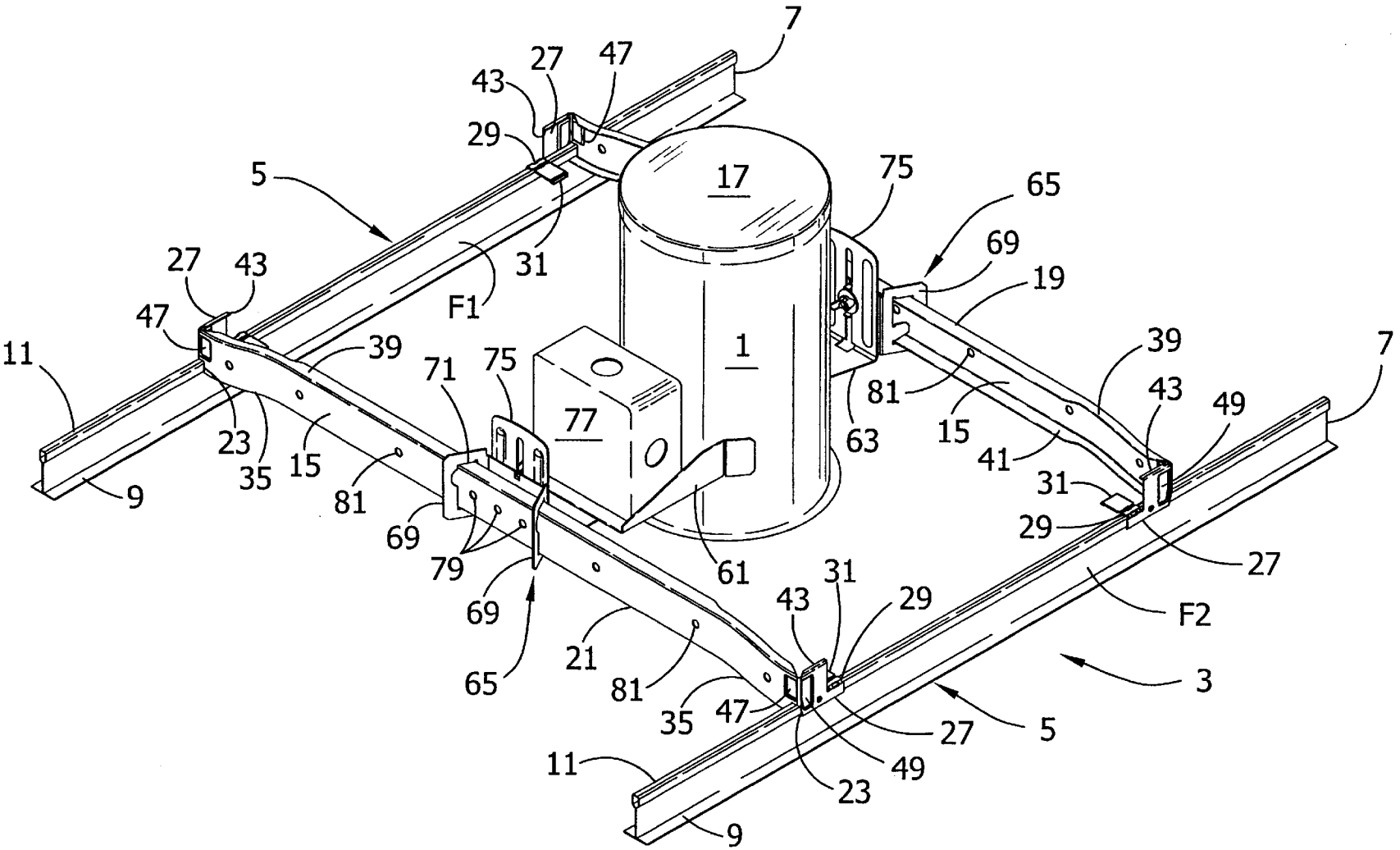
FIG. 8 is a view similar to FIG. 6 illustrating a second bending step.
Figure 9:
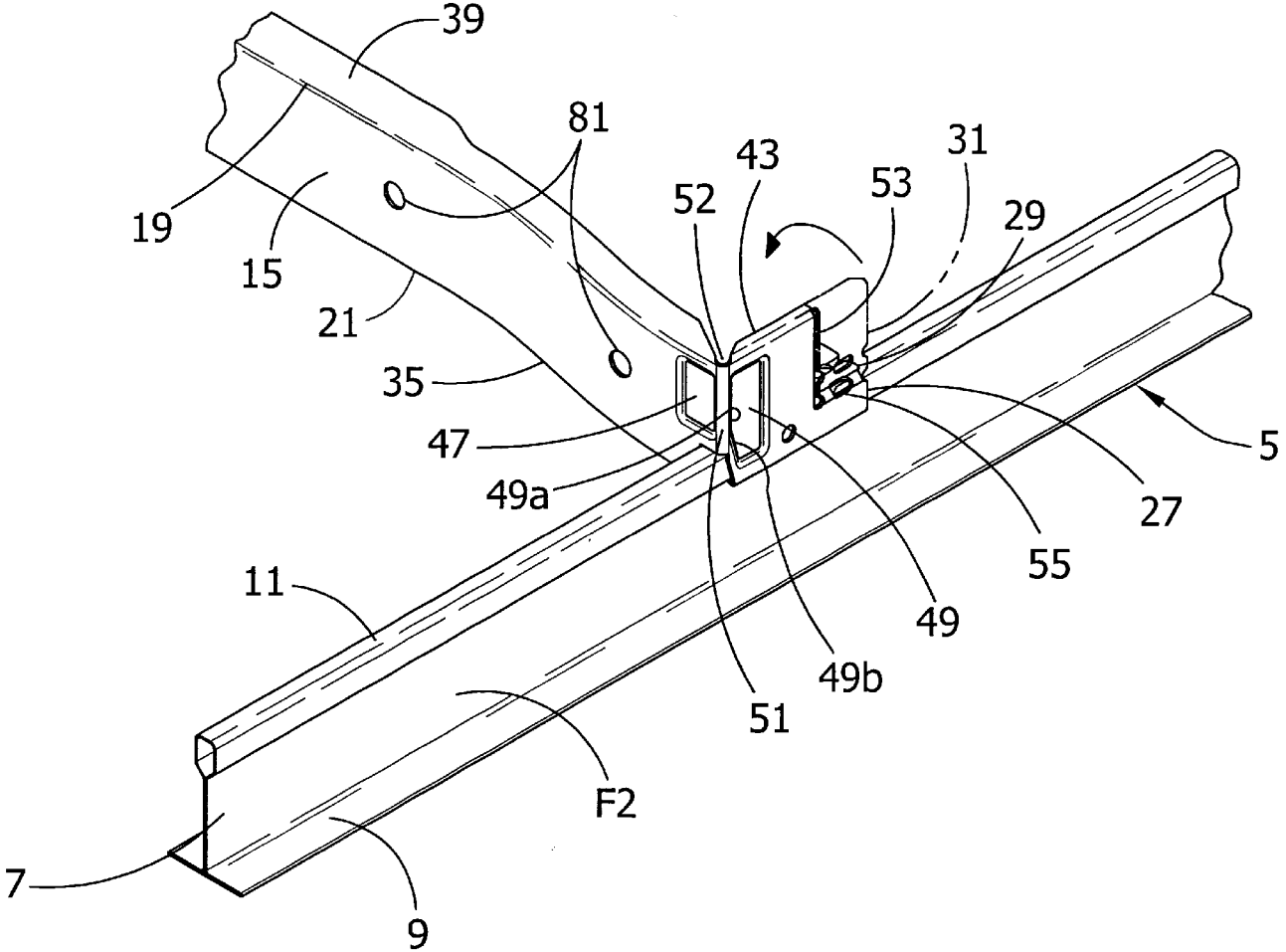
FIG. 9 is an enlarged fragment of FIG. 8 showing in phantom the end of a support after the first bend and in solid lines the disposition of said end after the second bend.
Figure 10:
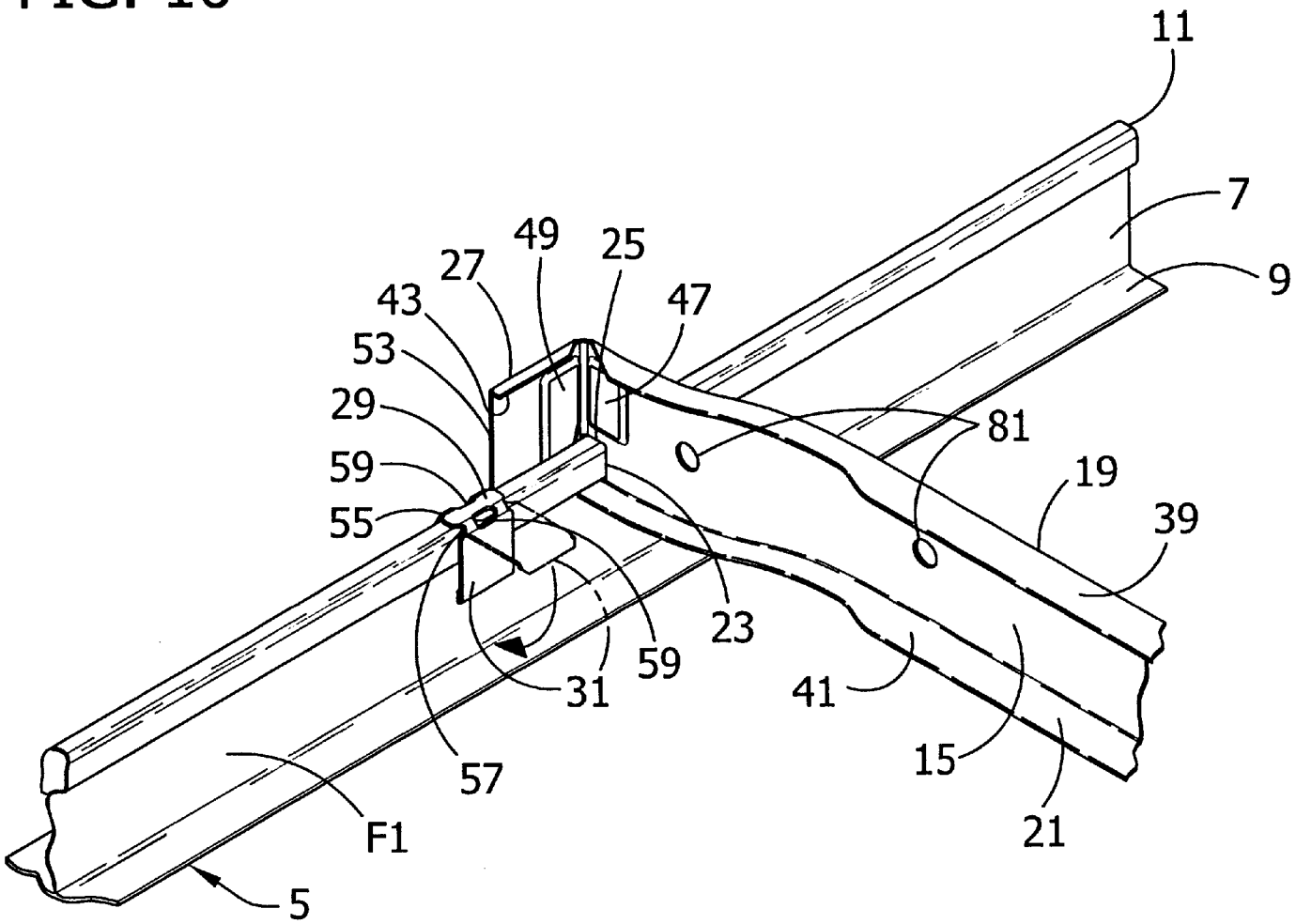
FIGS. 10 and 11 are fragmentary perspectives illustrating a third bend.
Figure 11:
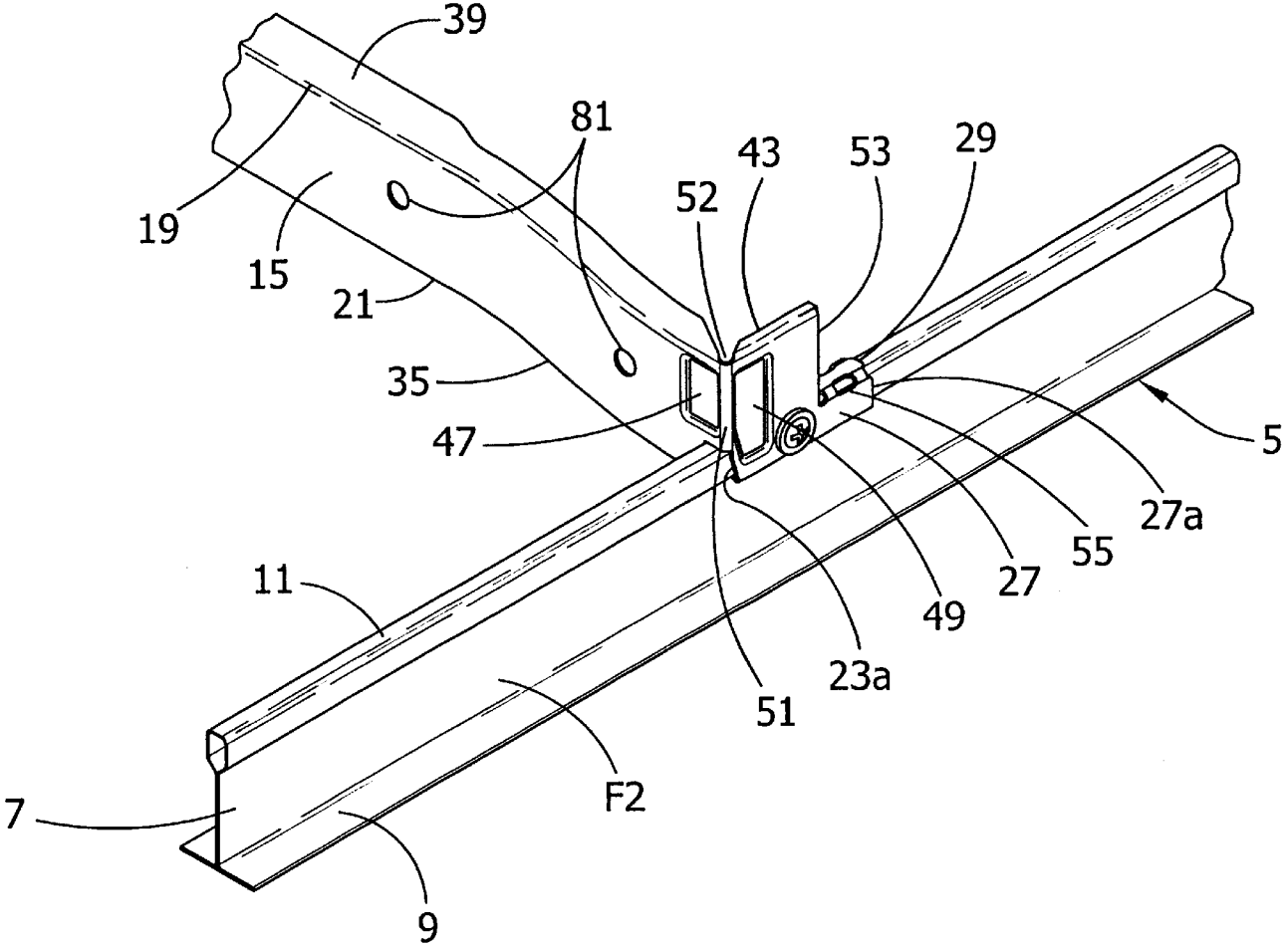
Figure 20:
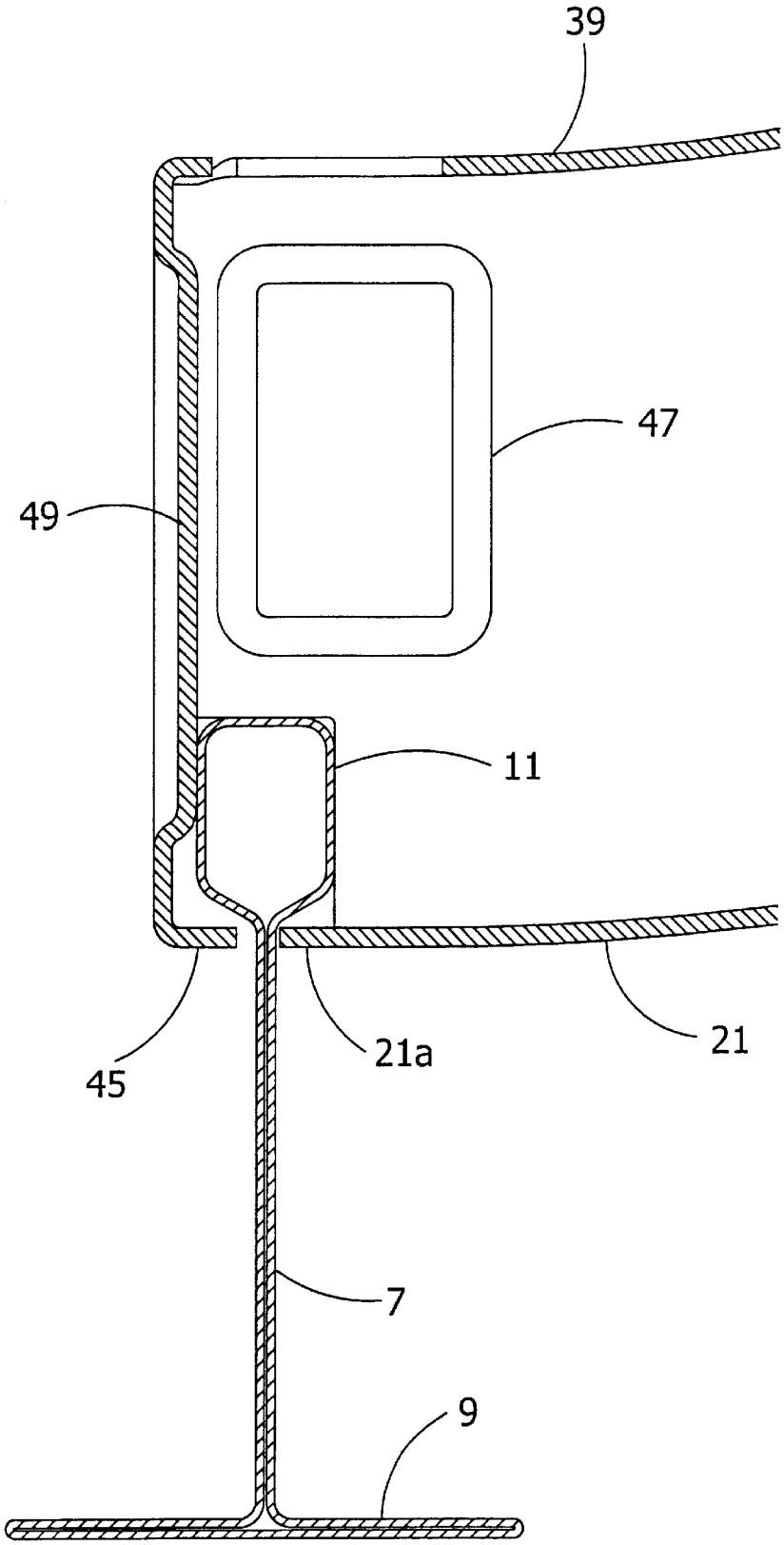
FIG. 20 is a vertical section taken on line 20—20 of FIG. 14.

Generally, the first step in the method of installing the lighting fixture 1 in its recessed position in the ceiling is to insert a bar 15 in each of the two bar receivers 65 on the brackets 61 and 63 in the manner illustrated in FIG. 3, the bars 15 being passed through (threaded through) the openings 71 in the flanges 69 to the point where the fixture 1 occupies a generally centered position with respect to the bars as shown in FIG. 4. The openings 71 are shaped to receive the bars generally in vertical position with the flanges 39 and 41 of each bar at the top and bottom of the openings. Centering is facilitated by having three holes 79 in each bar indicating the centered position of the fixture with respect to the bar. Other holes are indicated at 81. The pre-assembly of the fixture 1 and bars 15 of FIG. 4 is placed on the two inverted T-bars 5, with the enlarged edges or bulbs 11 of the webs 7 of the T-bars received in the notches 23, and the bars bridging the T-bars and bearing on the bulbs (see FIG. 5). As so applied, each bar 15 has its end portions 27 extending straight out beyond the notches 23. With the pre-assembly so positioned, the end portions are bent (generally by hand) to form the primary tabs 27 extending generally at right angles with respect to the bars 15 alongside the said second faces F2 of the two inverted T-bars 5. Then, the portion of each of the primary tabs 27 comprising the secondary tab 29 and the tertiary tab 31 is bent on the line 55 to extend generally at right angles to the primary tab over the bulb 11 of the respective inverted T-bar 5. And, finally, each tertiary tab portion 31 is bent on the respective line 57 to extend down generally at right angles to the secondary tab 29 on the inside face F1 of the respective inverted T-bar 5. As shown if FIGS. 15 and 20, this bending operation brings the outer boss 49 of each primary tab 27 into a position engaging the bulb 11 on the outside face F2 of the respective T-bar, the lower flange 45 of the primary tab into a position under the bulb 11 on the outside face F2 of the T-bar, with the edge of the flange 45 preferably generally contiguous to the web 7 of the T-bar 5, and the portion of flange 43 on the tertiary tab 31 into a position underlying and spaced below the bulb 11 on the inside face F1 of a respective T-bar. Further, the flange portion 21*a* of the lower flange 21 on the support bar 15 also underlies the bulb 11 on the inside face F1 of the web. As thus installed, the bars 15 and lighting fixture 1 supported thereby are securely held in fixed position on the T-bars 5.

Figure 12:
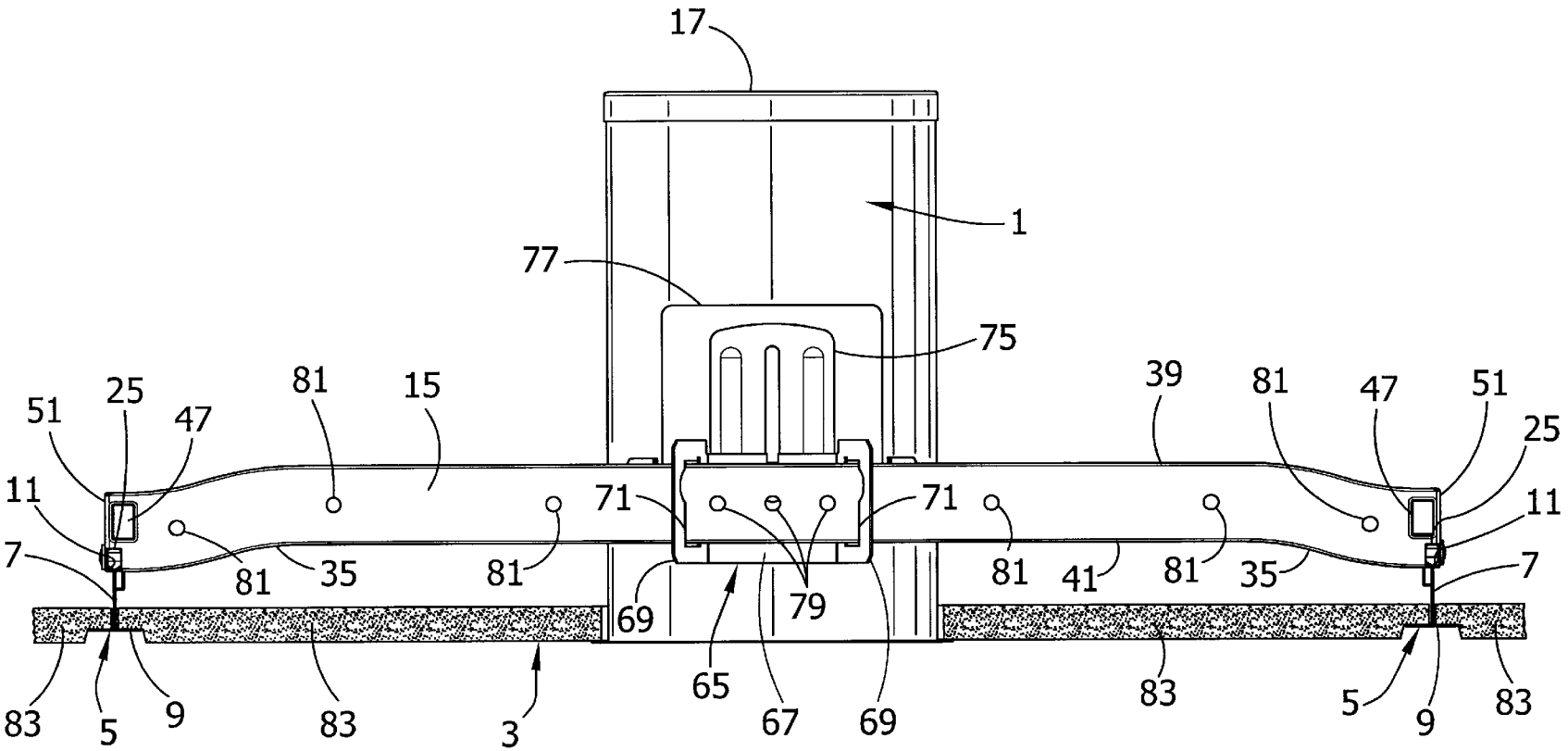
FIG. 12 is a view generally in cross-section on line 12—12 of FIG. 1.
Figure 13:
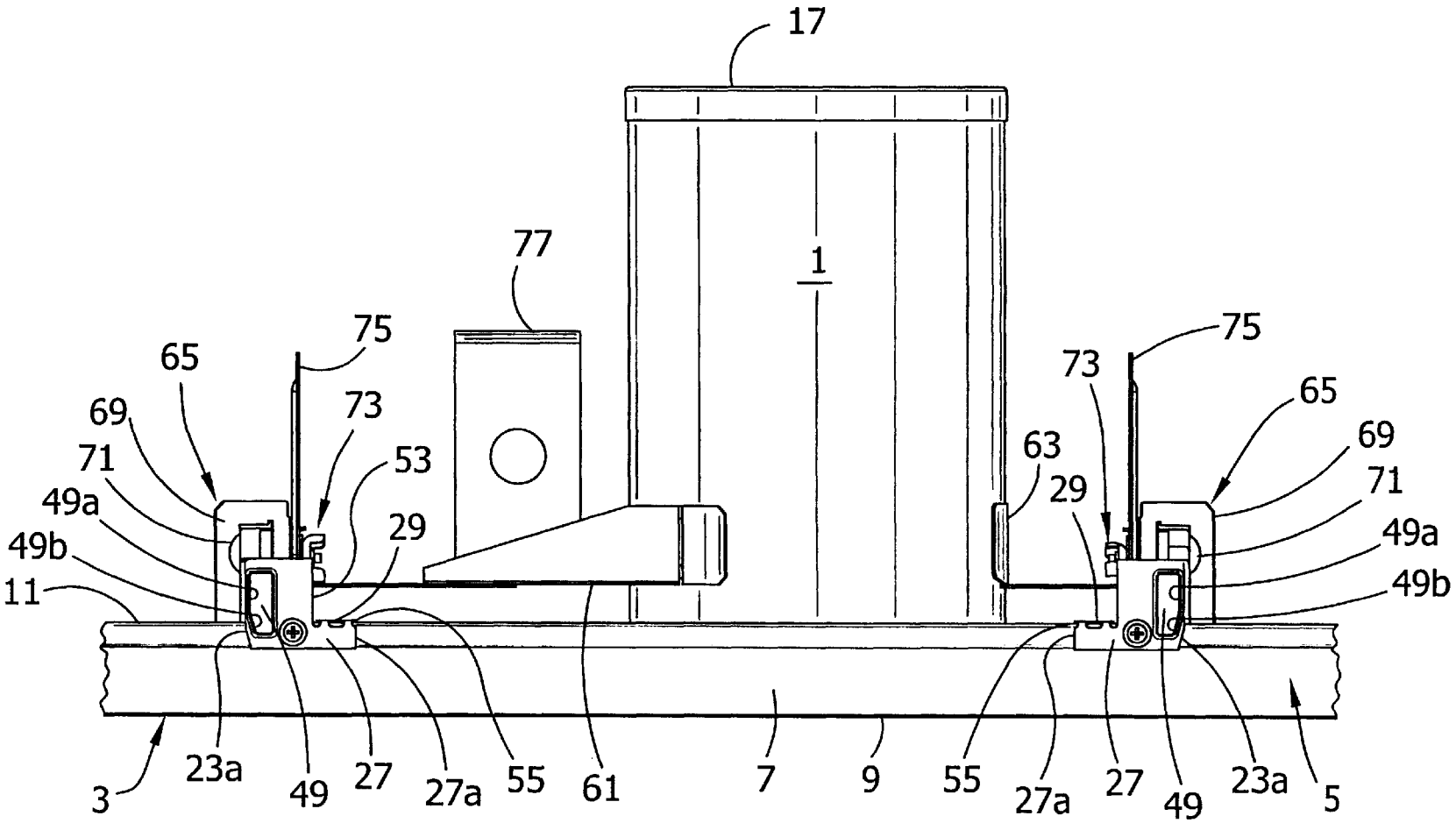
FIG. 13 is a side elevation of FIG. 1.

FIG. 12 shows the installation with ceiling tiles 83 in place for the ceiling. It will be observed therefrom that the support bars 15, with the end portions bent to provide the primary, secondary and tertiary tabs 27, 29 and 31, in no way obstruct the lifting up of ceiling tiles for placement in or removal from the ceiling. Further, since the flange portions 23*a* on the support bars 15 are engageable with the underside of the bulbs 11, the installation is held against lift-off from the T-bars if an upward force is applied to the installation, as during a change of a light bulb.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A support for mounting a lighting fixture in recessed position in a ceiling, the ceiling comprising a suspension of inverted T-bars, the support being for mounting the fixture between two of said inverted T-bars, said two inverted T-bars extending generally parallel to one another spaced apart a certain distance, each T-bar having a web constituting the stem of the T and a flange constituting the head of the T, the web having an enlarged edge, each T-bar having first and second side faces, the first faces being those that face one another and the second being those on the opposite side, said support comprising an elongate sheet metal bar for installation in generally vertical position bridging said two T-bars, said sheet metal bar having an edge constituting its upper edge and an edge constituting its lower edge as it is installed in said vertical position, said sheet metal bar having a pair of notches in its lower edge each sufficiently wide to accept the enlarged edge of the web of a T-bar, said notches being spaced apart said distance, said sheet metal bar being placeable in position on said two inverted T-bars bridging said two inverted T-bars with said enlarged edges of said two inverted T-bars being capable of extending through said notches, said sheet metal bar having end portions extending outward beyond the notches, each said end portion comprising a primary tab bendable to extend in a generally vertical plane generally at right angles with respect to the sheet metal bar in position extending alongside said second face of the respective inverted T-bar, each said end portion comprising said primary tab being formed to define a secondary tab for being bent to extend in a generally horizontal plane generally at right angles to the remainder of the primary tab across the enlarged edge of the respective inverted T-bar.

2. A support for mounting a lighting fixture in recessed position in a ceiling, the ceiling comprising a suspension of inverted T-bars, the support being for mounting the fixture between two of said inverted T-bars, said two inverted T-bars extending generally parallel to one another spaced apart a certain distance, each T-bar having a web constituting the stem of the T and a flange constituting the head of the T, the web having an enlarged edge, each T-bar having first and second side faces, the first faces being those that face one another and the second being those on the opposite side, said support comprising an elongate sheet metal bar for installation in generally vertical position bridging said two T-bars, said sheet metal bar having an edge constituting its upper edge and an edge constituting its lower edge as it is installed in said vertical position, said sheet metal bar having a pair of notches in its lower edge spaced apart said distance and being placeable in position on said two inverted T-bars bridging said two inverted T-bars with said two inverted T-bars being capable of extending through said notches, said sheet metal bar having end portions extending outward beyond the notches, each said end portion comprising a primary tab bendable to extend generally at right angles with respect to the sheet metal bar in position extending alongside said second face of the respective inverted T-bar, each said end portion comprising said primary tab being formed to define a secondary tab for being bent to extend generally at right angles to the remainder of the primary tab over the enlarged edge of the respective inverted T-bar, said support being formed to provide a tertiary tab for being bent down from the secondary tab on the first face of the respective inverted T-bar.

3. A support for mounting a lighting fixture in recessed position in a ceiling, the ceiling comprising a suspension of inverted T-bars, the support being for mounting the fixture between two of said inverted T-bars, said two inverted T-bars extending generally parallel to one another spaced apart a certain distance, each T-bar having a web constituting the stem of the T and a flange constituting the head of the T, the web having an enlarged edge, each T-bar having first and second side faces, the first faces being those that face one another and the second being those on the opposite side, said support comprising an elongate sheet metal bar for installation in generally vertical position bridging said two T-bars, said sheet metal bar having an edge constituting its upper edge and an edge constituting its lower edge as it is installed in said vertical position, said sheet metal bar having a pair of notches in its lower edge spaced apart said distance and being placeable in position on said two inverted T-bars bridging said two inverted T-bars with said two inverted T-bars being capable of extending through said notches, said sheet metal bar having end portions extending outward beyond the notches, each said end portion comprising a primary tab bendable to extend generally at right angles with respect to the sheet metal bar in position extending alongside said second face of the respective inverted T-bar, each said end portion comprising said primary tab being formed to define a secondary tab for being bent to extend generally at right angles to the remainder of the primary tab over the enlarged edge of the respective inverted T-bar, said support being formed to provide a tertiary tab for being bent down from the secondary tab on the first face of the respective inverted T-bar, each said primary tab having an upper edge, a lower edge and an outer edge, and a cut extending down from its upper edge toward and terminating short of its lower edge, the portion of said primary tab between the cut and the outer edge constituting said secondary and tertiary tabs.

4. A support for mounting a lighting fixture in recessed position in a ceiling, the ceiling comprising a suspension of inverted T-bars, the support being for mounting the fixture between two of said inverted T-bars, said two inverted T-bars extending generally parallel to one another spaced apart a certain distance, each T-bar having a web constituting the stem of the T and a flange constituting the head of the T, the web having an enlarged edge, each T-bar having first and second side faces, the first faces being those that face one another and the second being those on the opposite side, said support comprising an elongate sheet metal bar for installation in generally vertical position bridging said two T-bars, said sheet metal bar having an edge constituting its upper edge and an edge constituting its lower edge as it is installed in said vertical position, said sheet metal bar having a pair of notches in its lower edge spaced apart said distance and being placeable in position on said two inverted T-bars bridging said two inverted T-bars with said two inverted T-bars being capable of extending through said notches, said sheet metal bar having end portions extending outward beyond the notches, each said end portion comprising a primary tab bendable to extend generally at right angles with respect to the sheet metal bar in position extending alongside said second face of the respective inverted T-bar, each said end portion comprising said primary tab being formed to define a secondary tab for being bent to extend generally at right angles to the remainder of the primary tab over the enlarged edge of the respective inverted T-bar, said sheet metal bar having a first defined line of bending extending transversely thereof generally aligned with the outer edges of the notches for the bending of each of the primary tabs.

5. A support for mounting a lighting fixture in recessed position in a ceiling, the ceiling comprising a suspension of inverted T-bars, the support being for mounting the fixture between two of said inverted T-bars, said two inverted T-bars extending generally parallel to one another spaced apart a certain distance, each T-bar having a web constituting the stem of the T and a flange constituting the head of the T, the web having an enlarged edge, each T-bar having first and second side faces, the first faces being those that face one another and the second being those on the opposite side, said support comprising an elongate sheet metal bar for installation in generally vertical position bridging said two T-bars, said sheet metal bar having an edge constituting its upper edge and an edge constituting its lower edge as it is installed in said vertical position, said sheet metal bar having a pair of notches in its lower edge spaced apart said distance and being placeable in position on said two inverted T-bars bridging said two inverted T-bars with said two inverted T-bars being capable of extending through said notches, said sheet metal bar having end portions extending outward beyond the notches, each said end portion comprising a primary tab bendable to extend generally at right angles with respect to the sheet metal bar in position extending alongside said second face of the respective inverted T-bar, each said end portion comprising said primary tab being formed to define a secondary tab for being bent to extend generally at right angles to the remainder of the primary tab over the enlarged edge of the respective inverted T-bar, said sheet metal bar having a first defined line of bending extending transversely thereof generally aligned with the outer edges of the notches for the bending of each of the primary tabs, said primary tab having an upper edge, a lower edge and an outer edge, and a cut extending down from its upper edge toward and terminating short of its lower edge, the portion of each said primary tab between the cut and the outer edge constituting said secondary tab and further constituting a tertiary tab, each said primary tab having a second defined line of bending extending from the lower end of the cut to said outer edge and a third defined line of bending above and generally parallel to the second extending from the cut to said outer edge, the portion of the primary tab between said second and third defining lines the secondary tab and the portion of the primary tab above the third defining the tertiary tab.

6. A support as set forth in claim 5 wherein said first defined line of bending is defined by a narrow strip of the sheet metal of the bar between two bosses in the bar.

7. A support as set forth in claim 5 wherein each of said second and third defined lines of bending is defined by at least one opening in the sheet metal of the bar.

8. A support as set forth in claim 5 wherein the bar has flanges along its upper and lower edges, the lower flange having end portions for underlying the enlarged edges of the webs of the inverted T-bars.

9. An installation of a lighting fixture in recessed position in a ceiling, said ceiling comprising a suspension of inverted T-bars including two inverted T-bars extending generally parallel to one another spaced apart a certain distance, each T-bar having a web constituting the stem of the T and a flange constituting the head of the T, the web having an enlarged edge, each T-bar having first and second side faces, the first faces being those that face one another and the second being those on the opposite side, said installation comprising a pair of supports bridging the two T-bars with a space between said supports, and a lighting fixture supported by said supports in position between said supports and between said two T-bars extending up with respect to the level of the T-bars, each said support comprising an elongate sheet metal bar installed in generally vertical position bridging said two T-bars and thereby having an upper edge and a lower edge, each said sheet metal bar having a pair of notches in its lower edge spaced apart said distance receiving said two inverted T-bars, each said sheet metal bar having the upper edge of each notch bearing on the respective inverted T-bar, each said sheet metal bar having end portions outward of the notches, each said end portion comprising a primary tab bent to extend generally at right angles with respect to the sheet metal bar alongside said second face of the respective inverted T-bar, and each said end portion comprising said primary tab having a secondary tab bent to extend generally at right angles therefrom over the enlarged edge of the respective inverted T-bar.

10. An installation as set forth in claim 9 wherein a tertiary tab is bent down from each secondary tab on the first face of the respective T-bar.

11. The method of installing a lighting fixture in recessed position in a ceiling, said ceiling comprising a suspension of inverted T-bars including two inverted T-bars extending generally parallel to one another spaced apart a certain distance, each T-bar having a web constituting the stem of the T and a flange constituting the head of the T, the web having an enlarged edge, each T-bar having first and second side faces, the first faces being those that face one another and the second being those on the opposite side, comprising placing a pair of supports in position bridging the two T-bars with a space between said supports for supporting the fixture, each support comprising an elongate sheet metal bar placed in generally vertical position on the two T-bars and thereby having an upper edge and a lower edge, each said sheet metal bar having a pair of notches in its lower edge spaced apart said distance and positioned with the enlarged edges of the webs of the two inverted T-bars received in the notches and the upper edges of the notches bearing on said enlarged edges of the two inverted T-bars, each said sheet metal bar as applied having end portions extending straight out beyond the notches, bending said end portions to form primary tabs extending generally at right angles with respect to the sheet metal bars alongside said second faces of the two inverted T-bars, and bending portions of the primary tabs comprising secondary tabs to extend generally at right angles therefrom over the enlarged edges of the two inverted T-bars.

12. The method of claim 11 further comprising the step of bending down a tertiary tab from each secondary tab on the first face of the respective T-bar.

* * * * *